US007637329B2

(12) United States Patent
Stoik

(10) Patent No.: US 7,637,329 B2
(45) Date of Patent: Dec. 29, 2009

(54) METHODS AND SYSTEMS FOR DRILLING AUXILIARY HOLES

(75) Inventor: Randy Steven Stoik, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 12/009,328

(22) Filed: Jan. 17, 2008

(65) Prior Publication Data

US 2009/0183918 A1 Jul. 23, 2009

(51) Int. Cl.
*E21B 7/00* (2006.01)
*E21B 19/14* (2006.01)
*B23Q 5/00* (2006.01)

(52) U.S. Cl. ..... 175/57; 175/52; 175/85; 175/162; 175/203; 173/141

(58) Field of Classification Search ..... 166/77.2, 166/77.51, 85.1, 85.5, 241.1; 175/52, 85, 175/162, 203; 173/141, 145, 146, 163, 164, 173/165
See application file for complete search history.

(56) References Cited

U.S. PATENT DOCUMENTS

| | | | | |
|---|---|---|---|---|
| 2,810,550 | A | 10/1957 | Cohen et al. | |
| 3,719,238 | A | 3/1973 | Campbell et al. | 173/147 |
| 3,869,003 | A | 3/1975 | Yamada et al. | 175/171 |
| 4,208,158 | A | 6/1980 | Davies et al. | 414/22 |
| 4,296,821 | A | 10/1981 | Larson | 175/87 |
| 4,421,179 | A | 12/1983 | Boyadjieff | 173/44 |
| 4,442,904 | A | 4/1984 | Wibom | 173/28 |
| 4,529,045 | A * | 7/1985 | Boyadjieff et al. | 173/164 |
| 4,586,572 | A | 5/1986 | Myers et al. | 175/85 |
| 4,688,764 | A | 8/1987 | Nayler et al. | 254/277 |
| 4,809,788 | A | 3/1989 | Nelson | 173/28 |
| 4,813,496 | A | 3/1989 | Rohweller et al | 175/7 |
| 4,875,530 | A | 10/1989 | Frink et al. | 175/27 |
| 5,038,871 | A | 8/1991 | Dinsdale | 175/52 |
| 5,199,507 | A | 4/1993 | Westmoreland | 173/147 |
| 5,269,107 | A | 12/1993 | Klemm | 52/115 |
| 5,433,279 | A * | 7/1995 | Tessari et al. | 173/213 |
| 5,468,121 | A | 11/1995 | Stogner | 414/745.2 |
| 5,544,978 | A | 8/1996 | Albers | 405/232 |
| 6,209,851 | B1 | 4/2001 | Eilertsen | 254/338 |
| 6,860,337 | B1 * | 3/2005 | Orr et al. | 173/28 |
| 7,090,035 | B2 * | 8/2006 | Lesko | 175/57 |
| 7,228,919 | B2 | 6/2007 | Fehres et al. | 175/85 |
| 7,249,629 | B2 * | 7/2007 | Cunningham et al. | 166/77.1 |
| 2008/0210416 | A1 | 9/2008 | Lesko | 166/85.5 |

* cited by examiner

*Primary Examiner*—David J Bagnell
*Assistant Examiner*—Yong-Suk Ro
(74) *Attorney, Agent, or Firm*—Williams, Morgan & Amerson, P.C.

(57) ABSTRACT

Systems and methods for drilling auxiliary holes such as conductor holes, ratholes, and mouseholes useful in drilling operations. The systems and methods include the use of a portable drilling apparatus that is selectively mountable on a rig's drill floor and is removable after an auxiliary hole has been drilled. A movable drive unit is pulled down by a cable system forcing the drive unit down and thereby facilitating drilling of the auxiliary hole.

16 Claims, 18 Drawing Sheets

FIG. 7A (AUGER DRIVE UNIT IN WELL CENTER POSITION)

FIG. 8A (AUGER DRIVE UNIT IN MOUSEHOLE POSITION)

FIG. 9A (AUGER DRIVE UNIT IN RATHOLE POSITION)

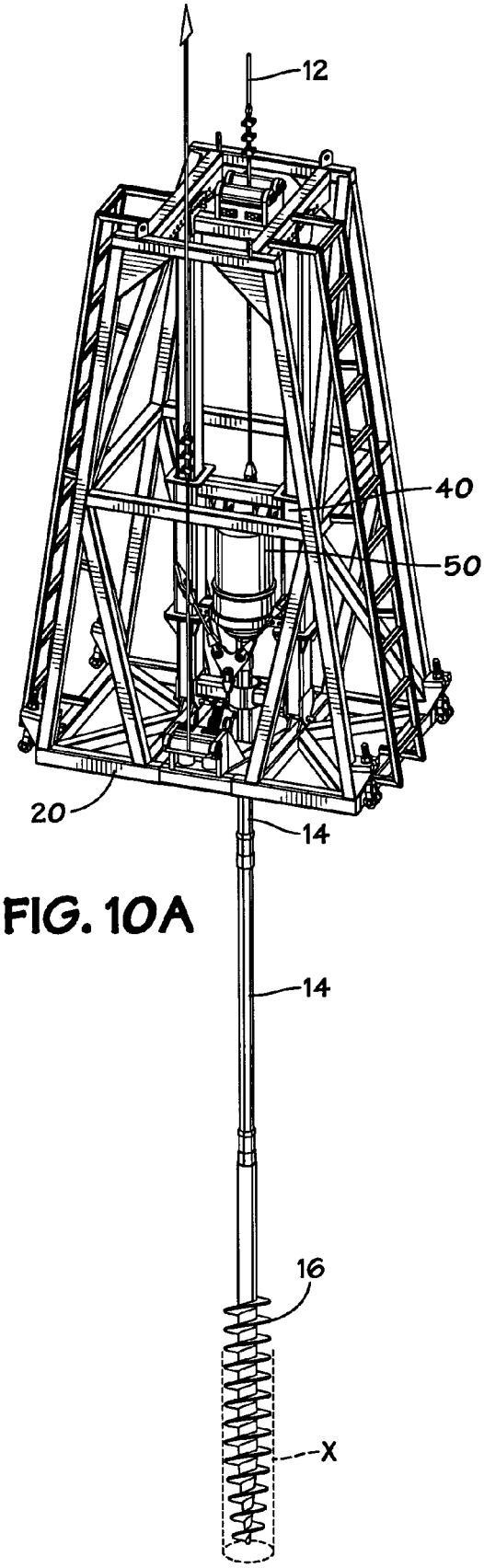
FIG. 10A
FIG. 10B
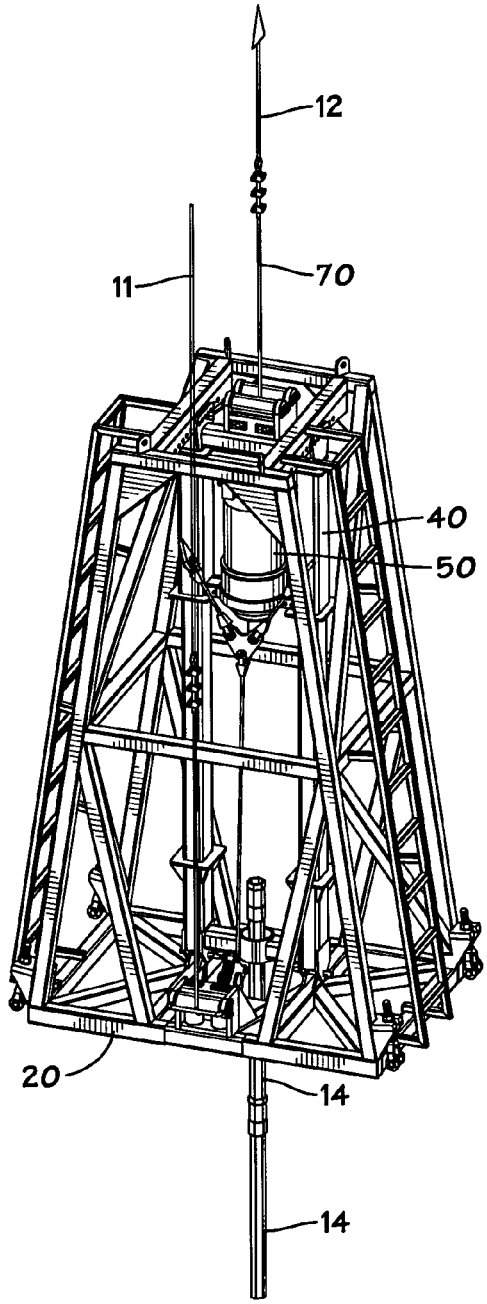

FIG. 10C
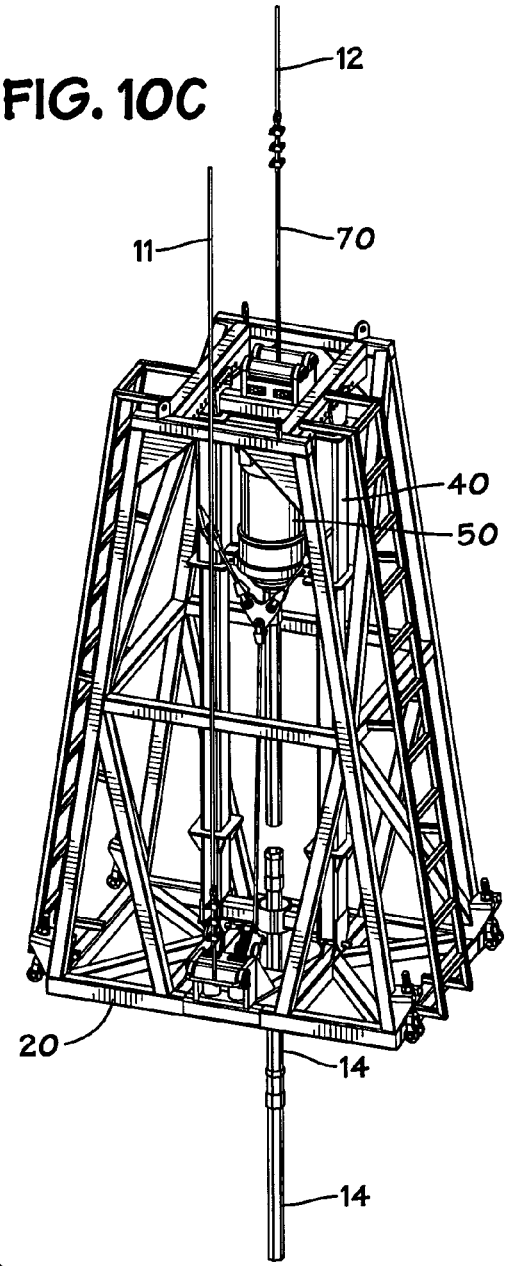
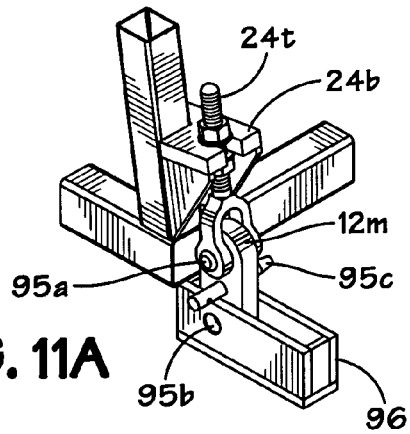
FIG. 11A
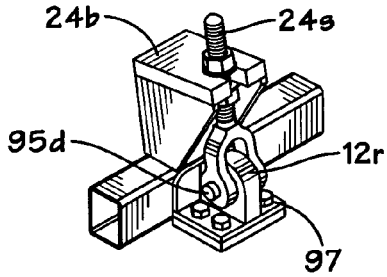
FIG. 11B

METHODS AND SYSTEMS FOR DRILLING AUXILIARY HOLES

BACKGROUND OF THE INVENTION

1. Field of the Invention

This invention is directed to wellbore drilling operations; systems for drilling auxiliary holes such as conductor holes, ratholes, and mouseholes useful in such operations; and methods of forming such auxiliary holes.

2. Description of Related Art

The prior art discloses a variety of methods and systems for drilling operations; for example, and not by way of limitation, those disclosed in U.S. Pat. Nos. 2,810,550; 3,340,938; 3,719,238; 3,807,109; 3,922,825; 3,942,593; 4,269,395; 4,290,495; 4,368,602; 4,421,179; 4,442,904; 4,489,526; 4,569,168; 4,809,788; 4,837,992; 4,875,530; 5,038,871; 5,199,507; 5,351,767; 5,468,121; 5,544,978; 6,209,851; 6,634,436; 6,523,319 and the references cited in these patents—all these patents incorporated fully herein for all purposes. The formation of auxiliary holes such as conductor holes, ratholes, and mouseholes and the use of such holes is common in such drilling operations. FIG. 1 illustrates a prior art drilling system.

In many drilling operations, prior to drilling a main wellbore, auxiliary holes such as a conductor hole, rathole, or mousehole are drilled near the location of the main wellbore. Typically, an auxiliary hole is drilled by a relatively small portable rig rather than by the drilling system that will be used to drill a main wellbore. Once the auxiliary hole has been drilled, the portable rig is removed. A variety or problems are associated with the use of such rigs; often including difficulties in transporting such rigs to remote locations where the main wellbore is to be drilled. Often, if auxiliary hole drillers are not available or cannot reach the drill site, some drillers use the kelly to drill these holes. Using the kelly to drill these holes can be dangerous to employees and personnel, since the workers have to pull the kelly over by hand or with winches to these holes and the resistance and weight of this equipment can make it difficult to maintain a precise drilling angle. This can lead to inaccurate angles for these holes which is undesirable. Guiding the drilling of an auxiliary hole with a kelly can be extremely difficult. The drill bit can move in any direction and precision can be lost. Also for kelly drilling, a rig mud system must be operational.

U.S. Pat. No. 3,719,238 discloses a compact, mobile, portable rotary drilling rig which enables the use of pipe of a length slightly less than the height of the mast. The drilling rig has a power driven swivel or drilling head connectable to a drill pipe, which swivel may be pulled down by a hydraulic cylinder-plunger arrangement, which cylinder is about one-half the length of the distance which the swivel is to be pulled down, and which cylinder is so constructed that no hoses are connected directly to the movable hydraulic cylinder. The hydraulic cylinder exerts tension on cables to perform the pull down action. Provision is made to mount the present compact, mobile, rotary drilling rig, including the mast, on a vehicle which may be enclosed in van-like insulated structure. In certain aspects such a portable drilling rig has: a base; a prime mover mounted on the base; an upstanding mast mounted on said base; a fluid powered swivel mounted on the mast for movement longitudinally thereof in guided relation; a fluid pump connected in driven relation with the prime mover; a piston rod having two hollow portions, mounted longitudinally of and within the mast and having a fluid blockage therein between the hollow portions; a movable fluid cylinder mounted on the hollow piston rod and being longitudinally movable with respect thereto; packing sealing the ends of the cylinder with respect to the hollow piston rod; a piston mounted on the piston rod within the length of the fluid cylinder; cable sheaves mounted on each end of the fluid cylinder; further cable sheaves mounted near each end of the mast; at least two cables connected to the fluid powered swivel and extending in opposite directions over the sheaves at each end of the mast and over the sheaves at each end of the cylinder, with a portion of the cable being restrained against substantial movement at each end of the mast; pressure control apparatus for directing fluid under pressure into the cylinder through on the portion of the hollow piston rod at one end thereof on one side of the piston and directing fluid under pressure out of the fluid cylinder on the other end of the piston and on the other side of the blockage in the hollow piston rod into the other portion of the hollow piston rod to move the cylinder relative to the piston by fluid pressure so as to move the swivel longitudinally of the mast by means of the cables connected thereto.

U.S. Pat. No. 4,421,179 discloses well drilling apparatus including a powered drilling unit connectable to the upper end of a drill string and adapted to rotate it to drill a well, and a vertically extending guide track structure which guides the drilling unit for movement along the axis of the well, with a portion of the guide track structure being mounted for swinging movement between a drilling position in which the drilling unit is aligned with the axis of the well and a slightly inclined position in which the track structure guides the drilling unit for movement along an inclined axis in alignment with a mousehole, and with the drilling unit also preferably being mounted for movement to a laterally retracted position at a side of the well in which it leaves an area along the axis of the well unobstructed for use of conventional hoisting equipment in making a round trip of the drill string out of and then back into the well. In one aspect such a well drilling apparatus includes: a mast or derrick; a drilling unit including an element adapted to be connected to the end of a drill string for rotation therewith about the axis of the string, and a motor operable to drive the element and the connected string rotatively about the axis; a pair of elongated first guide rails; a pair of shorter second guide rails forming lower extensions of the first rails; a carriage by which the drilling unit is carried and engaging the rails for movement therealong between an upper position of guided engagement with the first rails and a lower position of guided engagement with the second rails; pivotal connection means mounting the first rails near their upper ends for swinging movement of the first rails and the second rails and the carriage and carried drilling unit relative to the mast or derrick between drilling positions in which the carriage and drilling unit are guided by the first and second rails for movement along the axis of the drill string and inclined positions in which the first and second rails extend at an angle to the axis and guide the carriage and drilling unit for movement along an inclined path at an angle to the axis for access to a mousehole; and a connection mounting at least one of the second rails to a corresponding one of the first rails for movement therewith between the drilling and inclined positions, and for swinging movement relative thereto with the carriage and drilling unit to move the drilling unit from an active position of alignment with the axis to a retracted position at a side of the axis.

U.S. Pat. No. 5,038,871 discloses drilling equipment including apparatus for laterally moving a direct drive drilling unit to a position offset from the centerline of a well. The drilling equipment includes a traveling block suspended for generally vertical travel within a derrick during drilling of a well, a direct drive drilling unit suspendable from the traveling block, means for guiding the drilling unit during drilling and apparatus connected to the derrick for moving the drilling unit laterally relative to the axis of the well to an offset position. The drilling unit includes a drill motor and a drive sleeve for threadably connecting the drill motor to a drill string in the well. The guide means includes a first pair of rails connected to the derrick and extending parallel to the axis of the well. The apparatus includes a second pair of rails and means for supporting the drilling unit. The second pair of rails is positionable below and in alignment with the first pair of rails when the support means is in the offset position. In one aspect such equipment includes: means for suspending equipment for generally vertical travel within the derrick; a power swivel suspendable from the suspension means, said power swivel including a drill motor for rotating a drill string in a well, means for guiding the power swivel during travel, the guide means including a first pair of rails connected to the derrick and extending parallel to the axis of the well, and apparatus connected to the derrick for moving the power swivel laterally relative to the axis of the well to an offset position, the apparatus including a second pair of rails and means for supporting the power swivel, the second pair of rails being positioned below and in alignment with the first rails when the support means is in the offset position whereby the suspension means can travel the full length of the first and second pair of rails when the support means is in the offset position.

U.S. Pat. No. 5,544,978 discloses a machine for simultaneously augering and thrusting an anchor into the ground for later attachment of a utility pole or road sign. A vehicle is used to transport the thruster machine with a hydraulic control system such that a rail track is moved into thrusting position and locked in place. A winch, plus a system of hydraulic pistons will raise and lower an auger and thrusting device into the position desired. With an anchor affixed to the bottom of a platform, the auger is then used to drill out the dirt and other material so that the anchor may be more easily inserted into the ground. The thrusting process is facilitated by an indexing feature contained within the platform. A series of hydraulic pistons drive the anchor into the ground until fully stroked, whereupon the platform is re-indexed as needed to completely sink the anchor. A counter-thrust device may also be employed to stabilize the vehicle during the thrusting operation. Upon completion of the thrusting process, the platform is disengaged from the anchor and raised to its starting position. The rail track is then lowered back onto the flatbed truck, and the vehicle can then be driven to the next desired location for sinking an anchor. In one aspect a combined auger and thruster machine for driving anchors into the ground is disclosed that has: a thrust rail track maintainable in a stationary position, the thrust rail track having a top, the thrust rail track having a pair of spaced apart channel members interconnected by a plurality of cross-piece members, each the channel members having a plurality of dog receiving holes; a platform movable upon the thrust rail track, the platform having a dog wall assembly received by the channel members, the dog wall assembly having a dog piston to selectively engage a plurality of dogs that are received by the dog receiving holes, the platform having a platform wall, wherein the platform wall and the dog wall assembly are slidably interconnected by a plurality of pistons, the platform wall adaptable to receive an anchor, the anchor having an axial bore; and an auger carried by the platform and passing through the axial bore when the anchor is received by the platform, said plurality of pistons driving the platform with attached anchor and the auger when the plurality of dogs are received in the dog receiving holes.

BRIEF SUMMARY OF THE INVENTION

The present invention, in certain aspects, provides systems and methods for drilling an auxiliary hole useful in drilling operations, such as a conductor hole, rathole or mousehole.

In certain aspects, systems and methods according to the present invention employ a portable auger drive unit which is movably mounted on a support frame. The support frame is located on a rig's drill floor for drilling an auxiliary hole. The auger drive unit drives an auger that drills the auxiliary hole. The weight of the auger drive unit and connected structures provides downward force on the auger for drilling and, in certain aspects, a cable or cables connected to the drive unit pull on the drive unit (e.g. one cable pulling up and another pulling down) to apply downward force for drilling. One or more cables connected to the drive unit may be used. When using a single cable, the cable is disconnected for various steps. These cable(s) will be used in relative hard ground, in some rock formations, and in some frozen ground.

In certain aspects, the drive unit is secured to a mount structure that can be connected to the support frame within a range of angles with respect to the support frame. This makes it possible to drill the auxiliary hole at a desired angle to the drill floor. To accommodate non-flat ground on which the rig is located, the auger drive unit is raised or lowered and/or its angle with respect to the rig and ground is adjusted.

In certain aspects, the present invention provides such systems and methods in which, upon drilling down with the drive unit to a lower limit of its travel, the drive unit is raised and an additional extension member (or members) is added between the drive unit and the auger so that the depth of the auxiliary hole may be increased. Additional extension members are used in this manner until a desired depth is achieved.

In certain aspects, the present invention discloses such systems and methods in which, once the auxiliary hole is drilled to the desired depth, the drive unit is disconnected from the support frame and removed, and then the support frame is disconnected and removed so that installation of the main drilling equipment can commence; or, alternatively, the support frame with the drive unit still attached is disconnected from the drill floor and removed.

In certain aspects, the present invention discloses such systems and methods in which the drive unit is hydraulically powered; electrically powered; or pneumatically powered.

In certain aspects, with systems according to the present invention precision, accuracy, portability, efficiency are increased. With a unit according to the present invention precise holes can be drilled from the drill floor in exactly the correct spot and angle.

In certain aspects units according to the present invention can be mounted on the back of a regular truck since the overall dimensions, in some aspects, are 4 feet by 6 feet making it very portable.

In certain aspects, a unit according to the present invention can be transported to other similar rigs, thus this one unit can service many rigs.

In certain aspects, units according to the present invention use hydraulics and winch lines from the crown, and there is, therefore, no need for the mud system to drill auxiliary holes. While some crew members drill the auxiliary holes, other crew members can set up the mud system thus saving time.

Accordingly, the present invention includes features and advantages which are believed to enable it to advance auxiliary hole drilling technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious systems and methods for drilling auxiliary holes useful in drilling operations; and Such systems and methods in which a portable drilling system, selectively mountable on a rig, is used to drill an auxiliary hole and is then removable from the rig so that main wellbore drilling operations can commence;

Such systems and methods in which an auger drive unit according to the present invention can drill a conductor hole, a rathole, and/or a mousehole for a rig;

Such systems and methods in which an auxiliary hole can be drilled at a desired angle to the a rig's drill floor; and Such systems and methods in which one or more cables provide downward force on the portable drilling system for drilling the auxiliary hole.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 7A is a top view of a rig and an auger drive unit according to the present invention.

FIG. 8A is a top view of part of a rig with the auger drive unit as shown in FIG. 7A moved to a different position.

FIGS. 9A-9C show drilling a rathole with a system according to the present invention.

FIG. 9C shows the system angle set for drilling the rathole.

FIG. 9A is a top view of part of a rig with the auger drive unit as shown in FIG. 7A moved to a different position.

FIG. 9B is a top schematic view of the rig of FIG. 9A.

FIG. 9C is a side view of part of the auger drive unit of FIG. 9A.

FIG. 10A is a perspective view of an auger drive unit according to the present invention in a step of a method according to the present invention.

FIG. 10B is a perspective view of the auger drive unit of FIG. 10A in a subsequent step of the method according to the present invention.

FIG. 10C is a perspective view of the auger drive unit of FIG. 10A in a subsequent step of the method according to the present invention.

FIG. 11A is a perspective view of connection apparatus between an auger drive unit according to the present invention and a drill floor.

FIG. 11B is a perspective view of connection apparatus between an auger drive unit according to the present invention and a drill floor.

Figure 1:
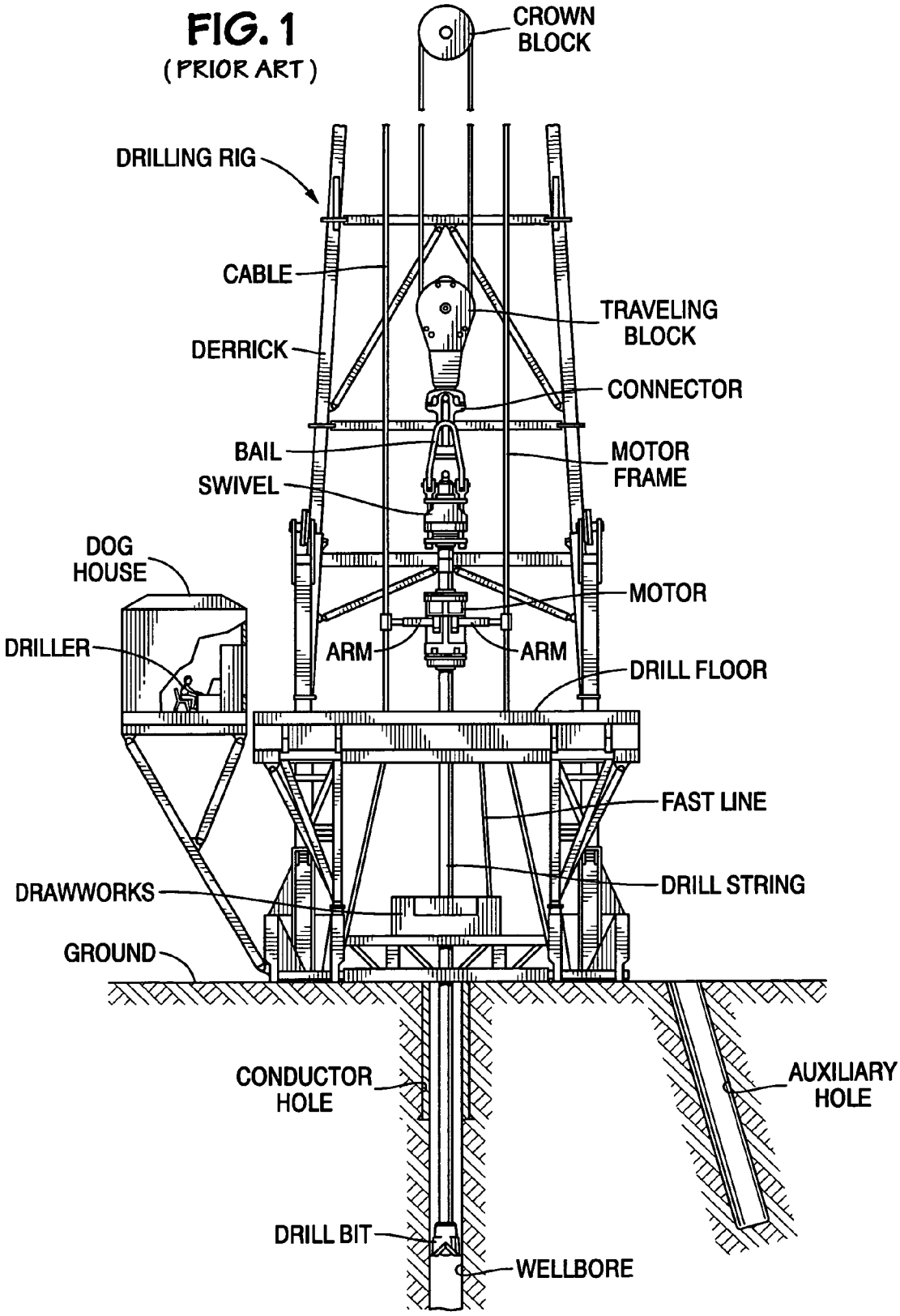
FIG. 1 (PRIOR ART)
FIG. 1 is a side schematic view of a prior art drilling system.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1 illustrates a prior art drilling rig which, as shown, has a top drive system for rotating a drill string; but as is well-known, any suitable rotary apparatus on a drill floor may be used for this purpose. The prior system as shown in FIG. 1 has a drilling rig with a rig floor, a derrick, a crown block, and strands of a cable, by which a traveling block is vertically positioned. A lower end of the traveling block is connected to an upper end of a swivel. The swivel is supported by bails from a connector. A drilling motor has a hollow output shaft that directly drives a drill string with a drill bit used for drilling a main wellbore. The motor has opposed arms attached to a motor frame. The traveling block moves vertically within the derrick and the swivel, motor, and drill string are carried therewith. A drawworks drive is positioned to accept the marginal end of a cable about a drawworks drum. A dog house houses control panels and electronic circuitry for controlling the operation of the drilling rig. A fast line extends from drum of the draw works and is rove between the crown block and traveling block. The system of FIG. 1 includes an auxiliary hole (or holes) adjacent a main wellbore which was not drilled with the drill string and drill bit; e.g., a rathole or mousehole used in the drilling operations. Optionally, a typical rotary apparatus, not shown, is used to drill the main wellbore.

Figure 2A:
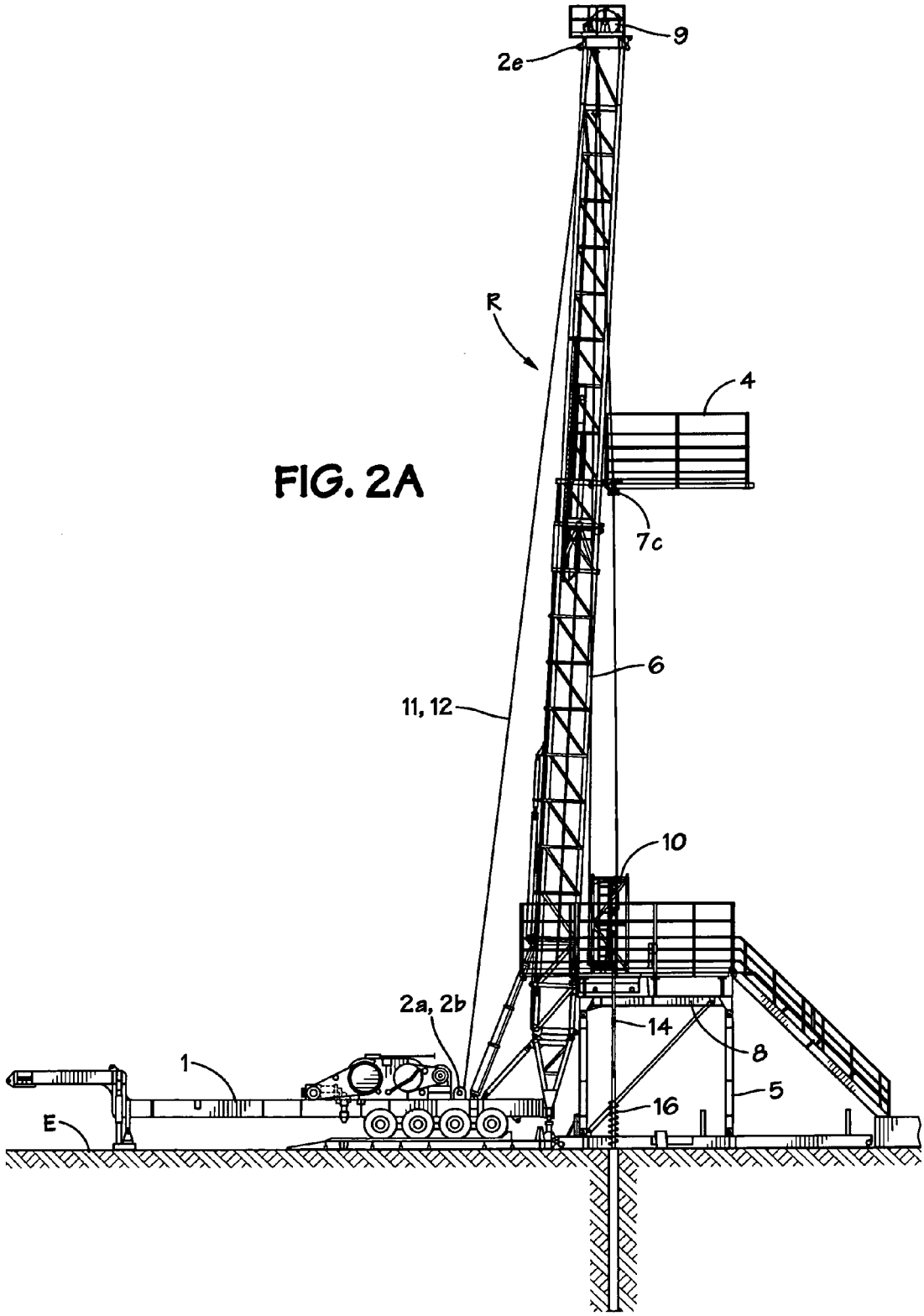
FIG. 2A is a side view of a rig according to the present invention with an auger drive unit according to the present invention.
Figure 2B:
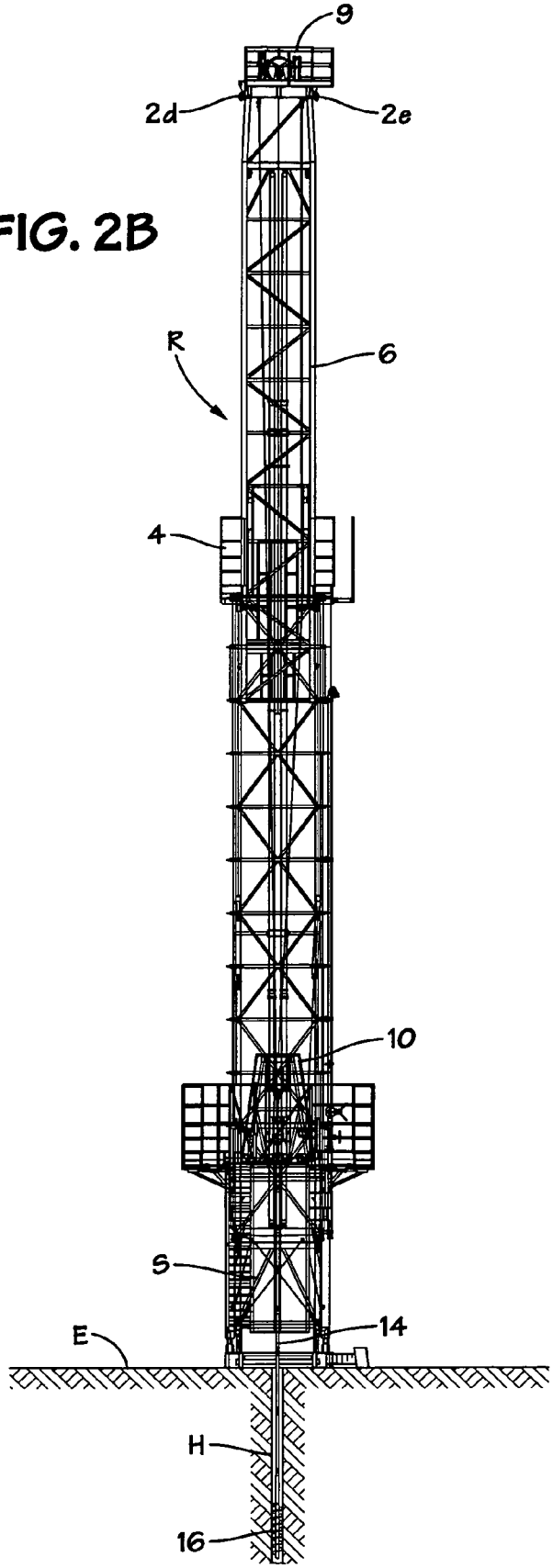
FIG. 2B is a front view of the rig of FIG. 2.

FIGS. 2A and 2B show a rig R according to the present invention with an auger drive unit 10 according to the present invention secured to a drill floor 8 of a substructure 5. The drill floor 8 supports a mast 6 which has a racking board 4 secured thereto. Cables 11 and 12 extend from the auger drive unit 10 up to a crown block structure 9 of the rig R and down to winches 2*a*, 2*b* on a rig carrier frame 1 (e.g. a trailer or drilling unit that supports equipment, e.g. a drawworks, engines, winches, etc). An extension 14 with an auger 16 attached thereto project down from the auger drive unit 10. In certain aspects, with a rig floor that is about 20 feet high, about eight (plus-or-minus one) extensions 14 are used, each about 4 feet long, with an auger that is about 9 feet long for a 15 foot deep mousehole or a 15 foot deep rathole.

As shown in FIG. 2B, the auger 16 of the auger drive unit 10 has drilled a conductor hole H in the earth E.

Figure 2C:
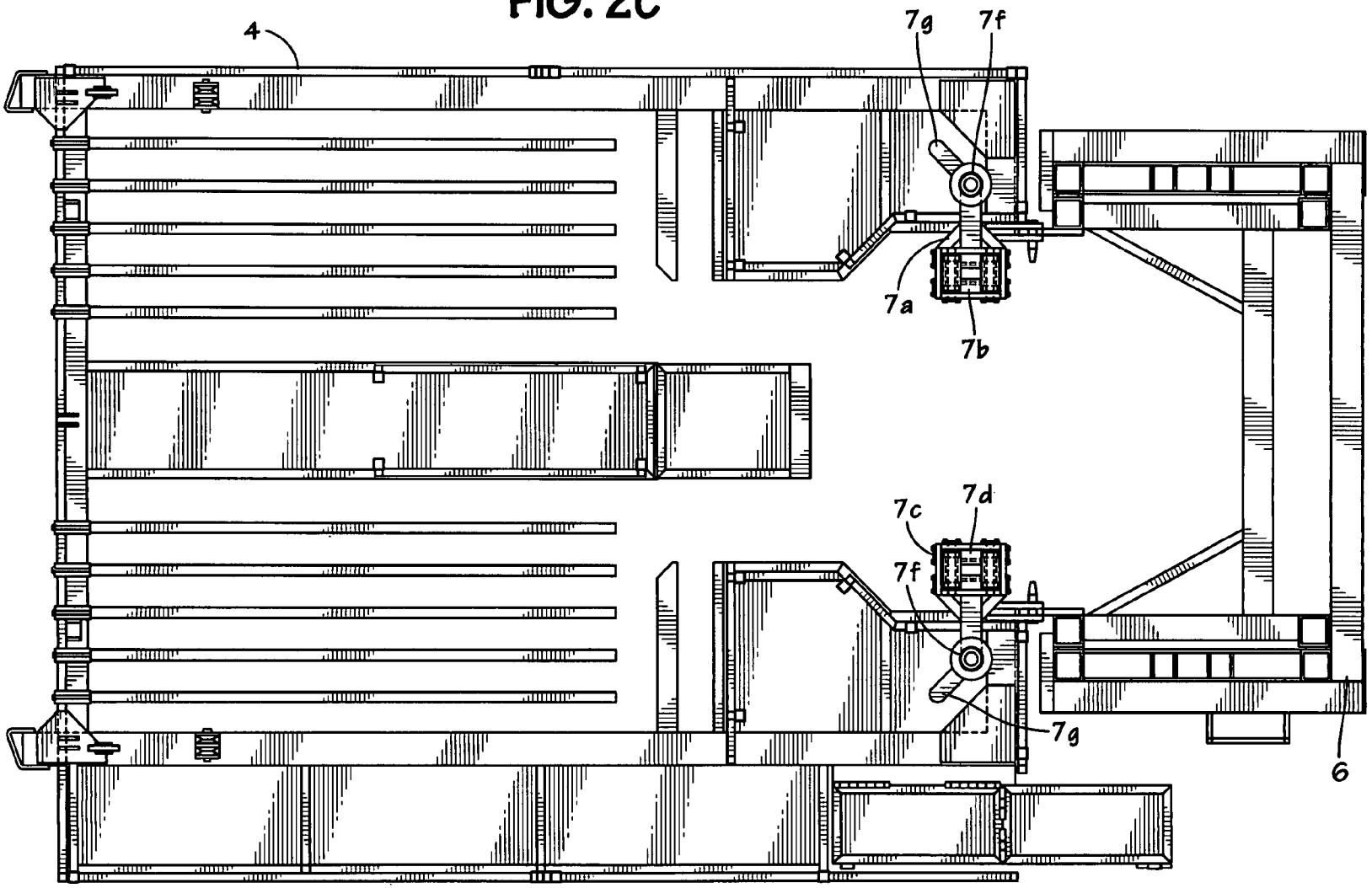
FIG. 2C is a top view of a racking board of the rig of FIG. 2A.

FIG. 2C illustrates the racking board 4 and a guide pivot arm 7*a* with a roller apparatus 7*b* for guiding the cable 12; and a guide pivot arm 7*c* with a roller apparatus 7*d* for guiding the cable 11. Each guide pivot arm is pivotable on a shaft 7*f* by moving a handle 7*g*; e.g. to move the guide pivot arms out of the way of a travelling block in the rig.

The winches, winches 2*a* and 2*b*, typically mounted close to a drawworks DK winch the cables that run from the winches up to the crown block structure 9, around sheaves 2*d* and 2*e*, and then down to the drill floor 8 to the auger drive unit 10. The cable 12 goes from the winch 2*a* to the sheave 2*d* to a cable assembly 70. The cable 11 goes from the winch 2*b* to the sheave 2*e* to a cable assembly 60. The winches 2*a* and 2*b* are powered, e.g., hydraulically, and these winches winch the cables 11, 12 up.

Figure 2D:
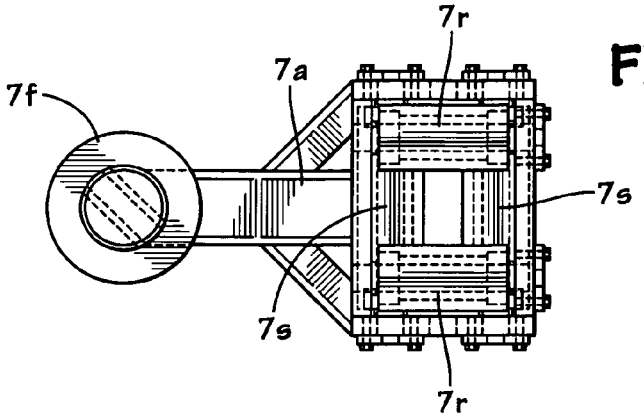
FIG. 2D is a top view of a guide pivot arm of the rig of FIG. 2A.
Figure 2E:
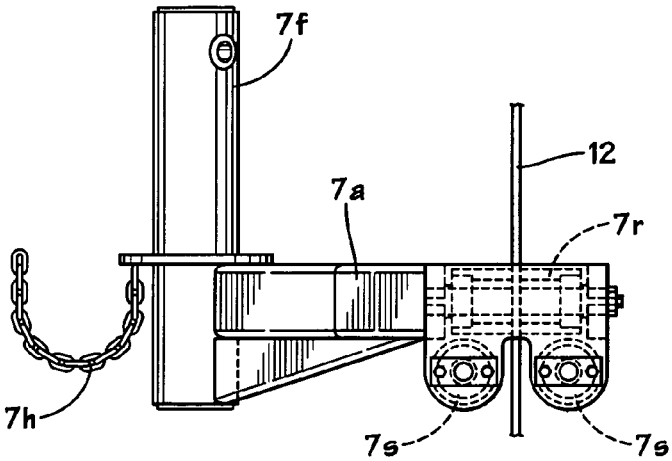
FIG. 2E is a side view of the a guide pivot arm of the rig of FIG. 2D.
Figure 2F:
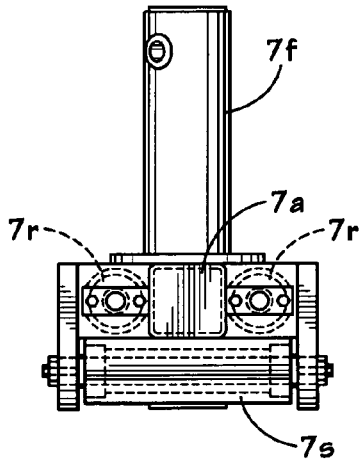
FIG. 2F is a front view of the a guide pivot arm of the rig of FIG. 2D.
Figure 2G:
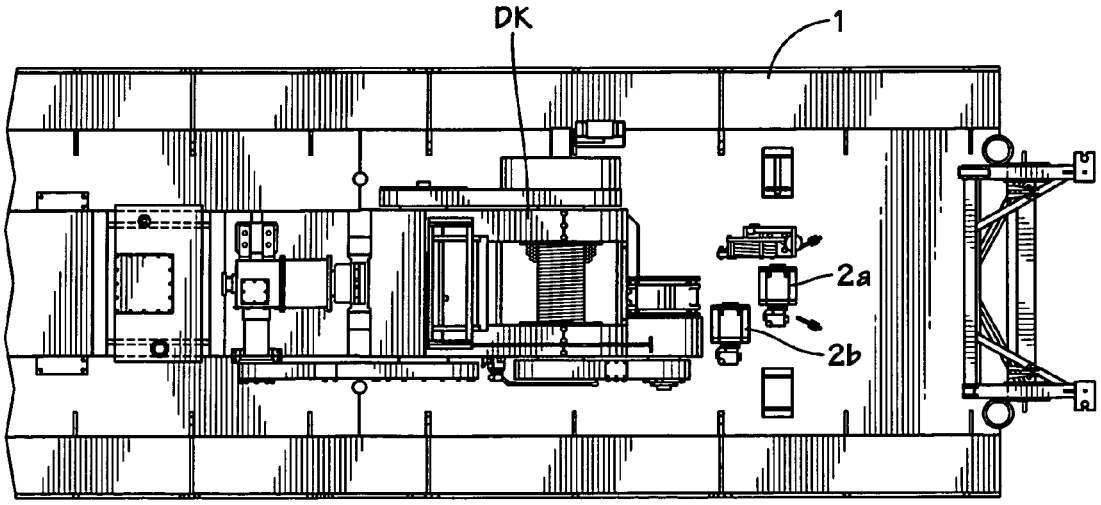
FIG. 2G is a top view of a floor of the rig of FIG. 2A.
Figure 3A:
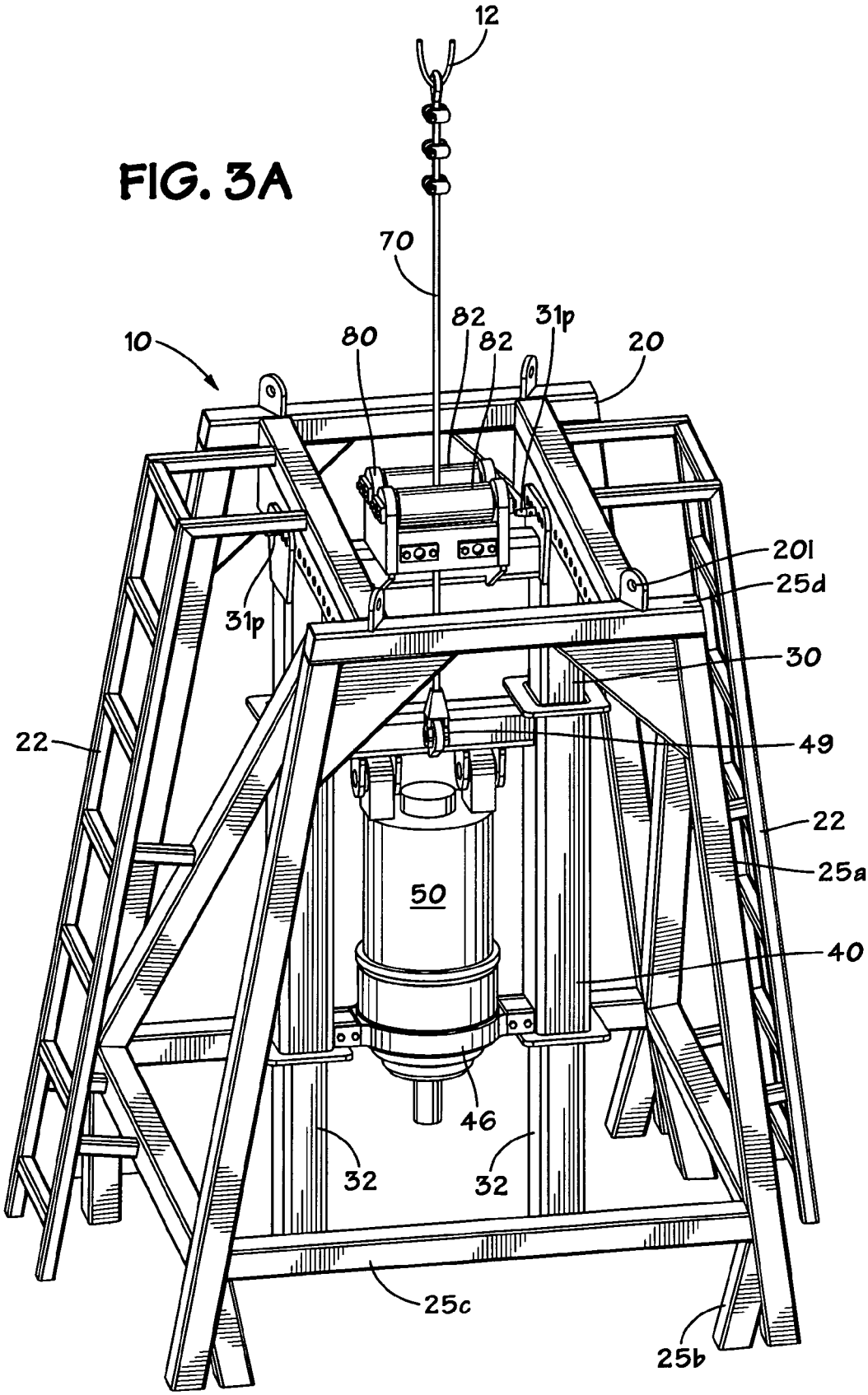
FIG. 3A is a perspective view of an auger drive unit according to the present invention.
Figure 3B:
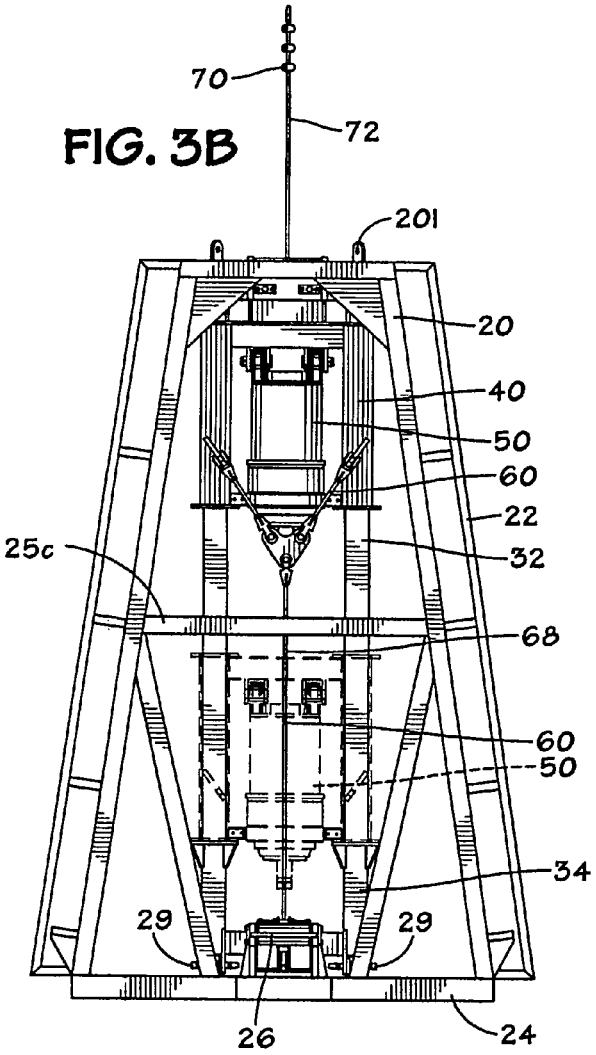
FIG. 3B is a front view of the auger drive unit of FIG. 3A.
Figure 3C:
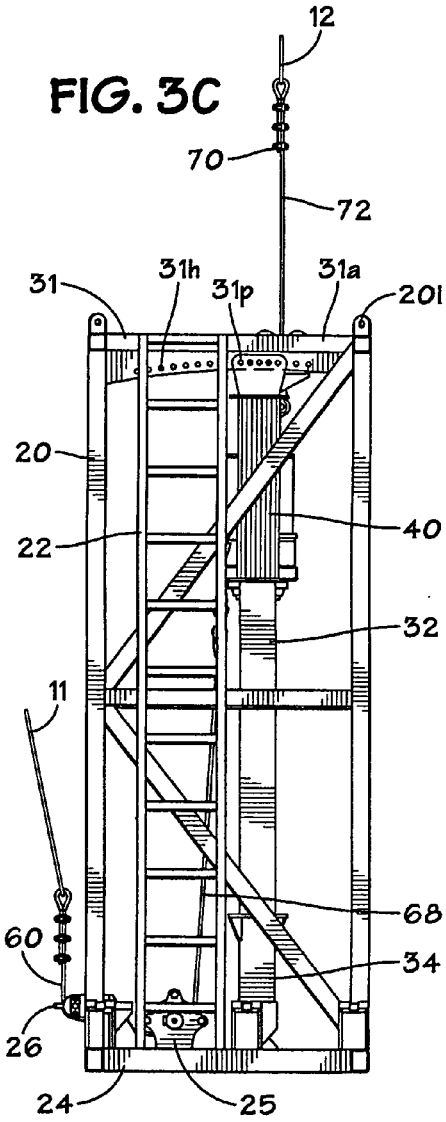
FIG. 3C is a side view of the auger drive unit of FIG. 3A.
Figure 3D:
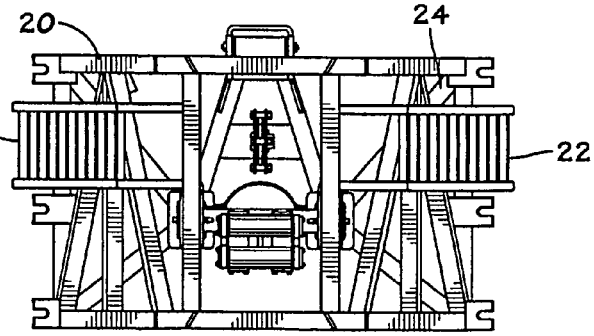
FIG. 3D is a top view of the auger drive unit of FIG. 3A.
Figure 4:
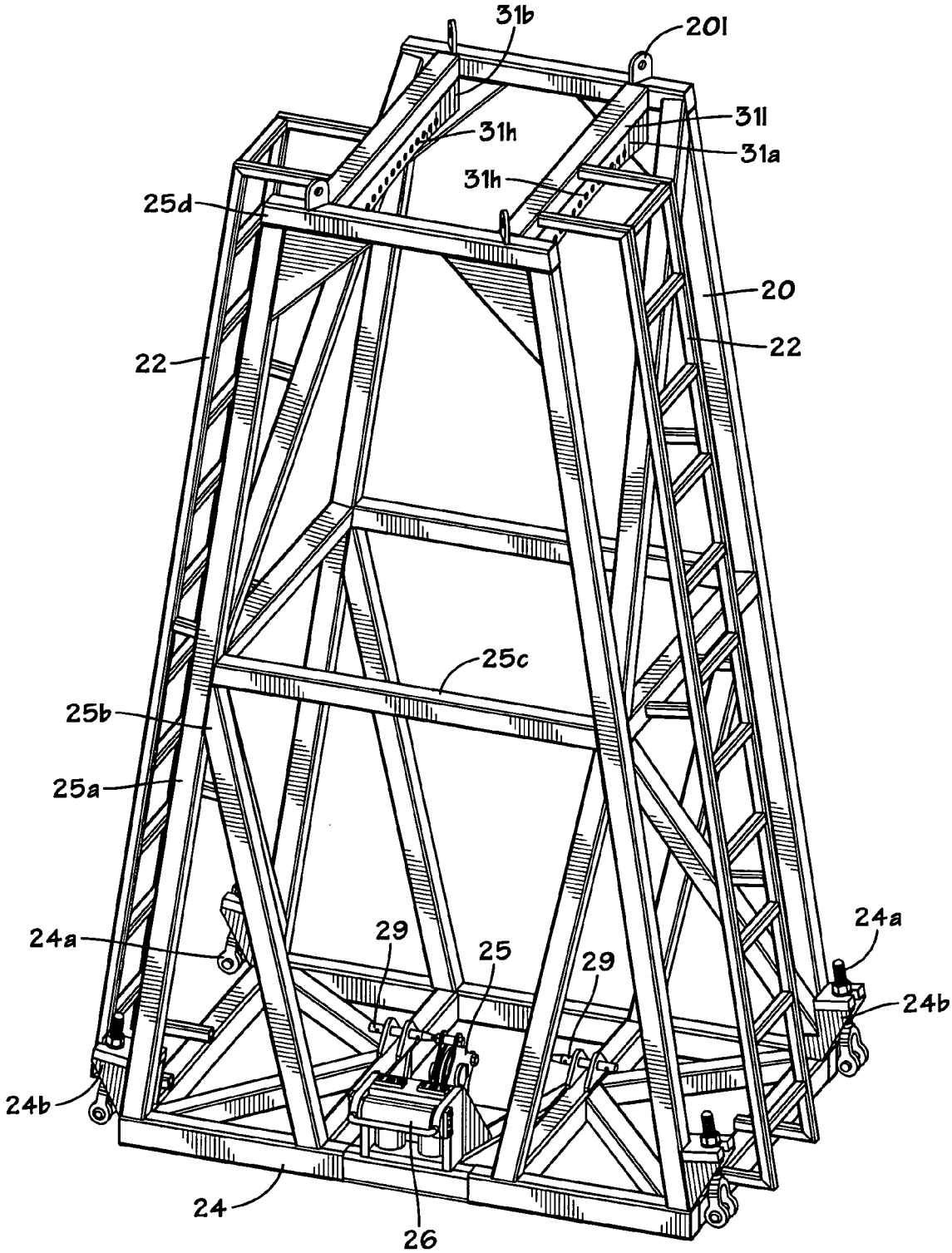
FIG. 4 is a perspective view of structure of the auger drive unit of FIG. 3A.
Figure 5A:
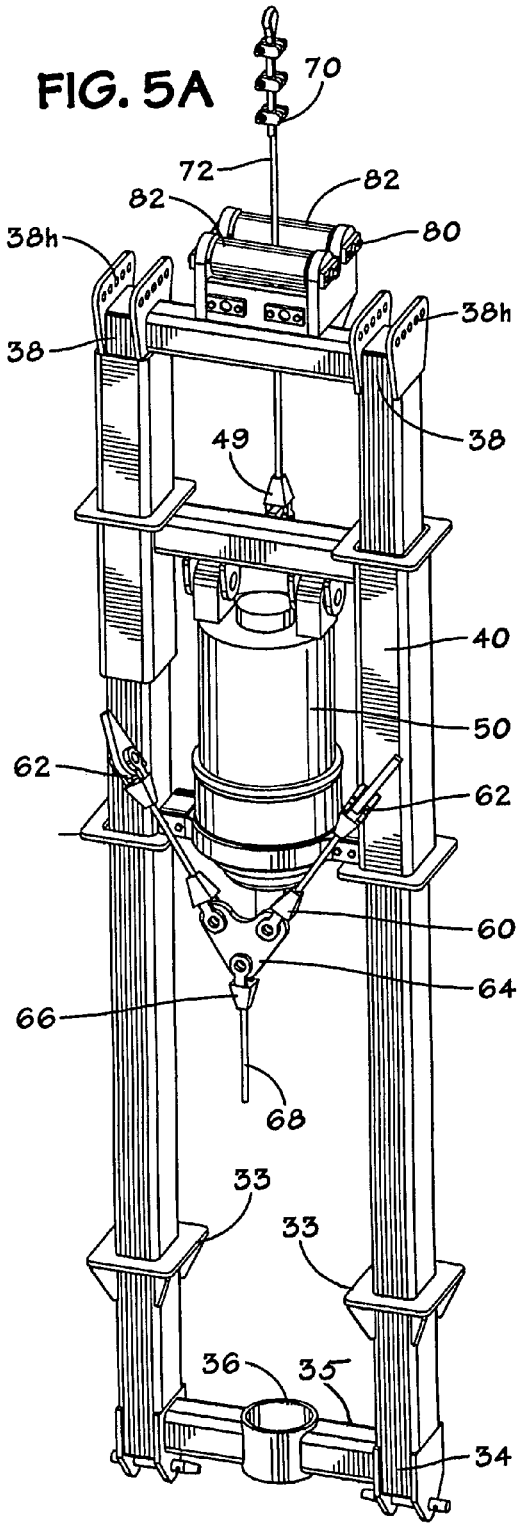
FIG. 5A is a perspective view of structure of the auger drive unit of FIG. 3A.
Figure 5B:
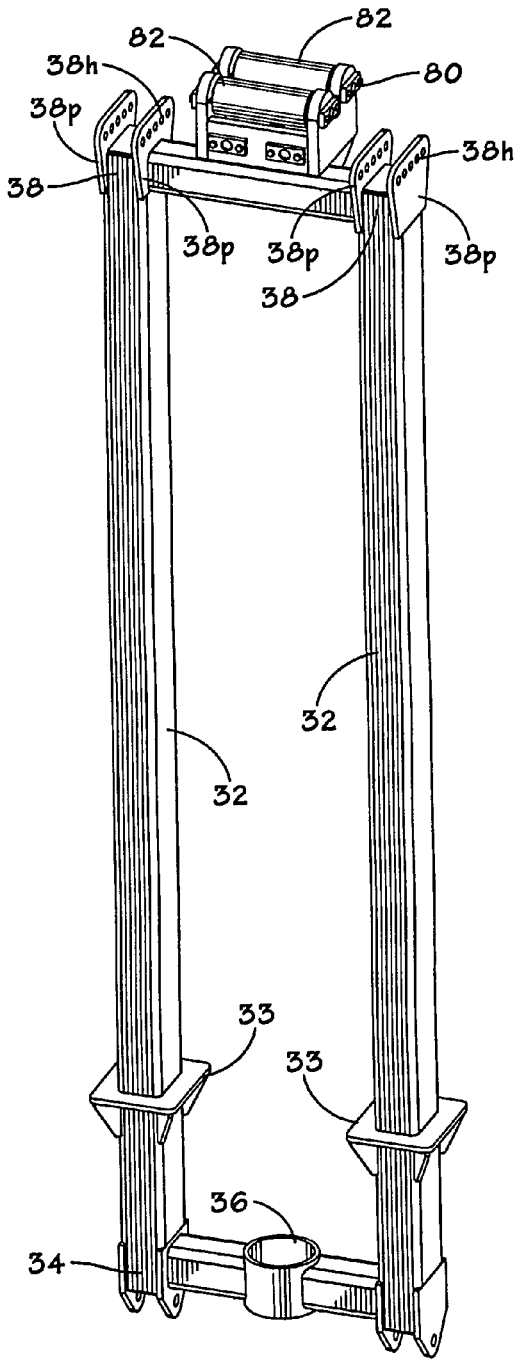
FIG. 5B is a perspective view of parts rails of the auger drive unit of FIG. 3A.
Figure 5C:
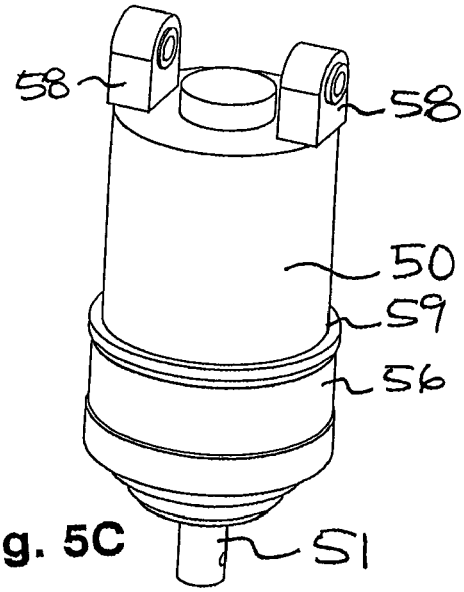
FIG. 5C is a perspective view of the drive of the auger drive unit of FIG. 3A.
Figure 5D:
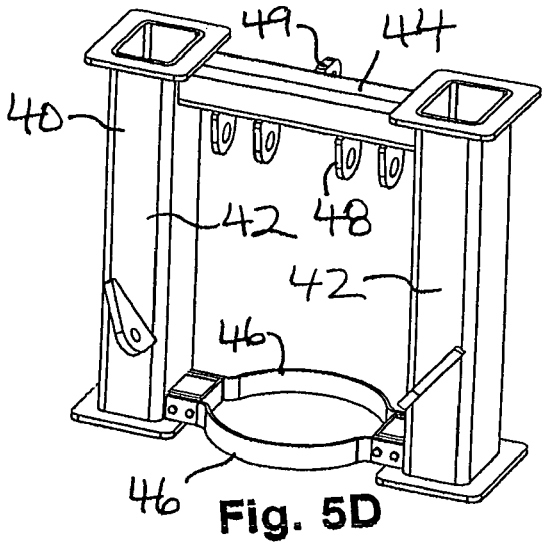
FIG. 5D is a perspective view of a housing of the auger drive unit of FIG. 3A.
Figure 5E:
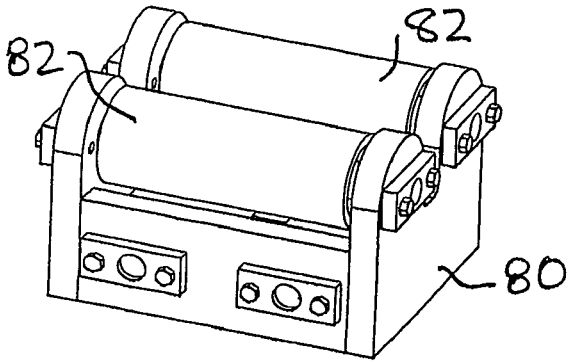
FIG. 5E is a perspective view of a roller apparatus of the auger drive unit of FIG. 3A.
Figure 5H:
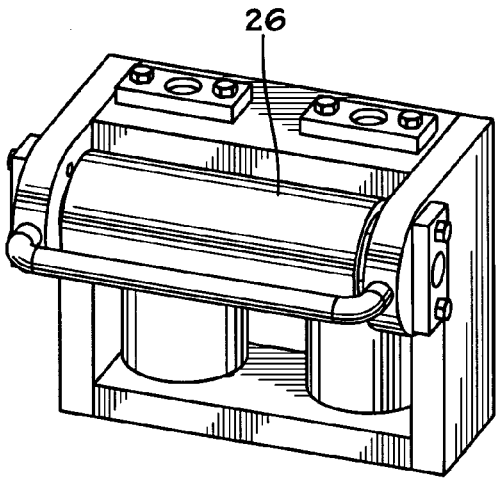
FIG. 5H is a perspective view of a roller apparatus of the auger drive unit of FIG. 5A.
Figure 5I:
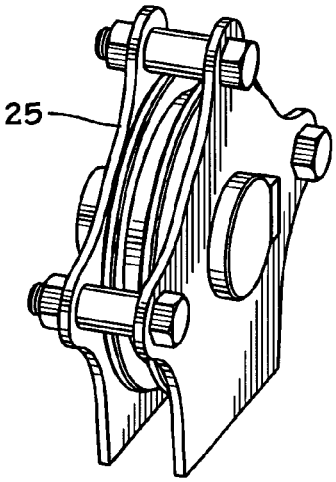
FIG. 5I is a perspective view of a sheave of the auger drive unit of FIG. 5A.
Figure 5F:
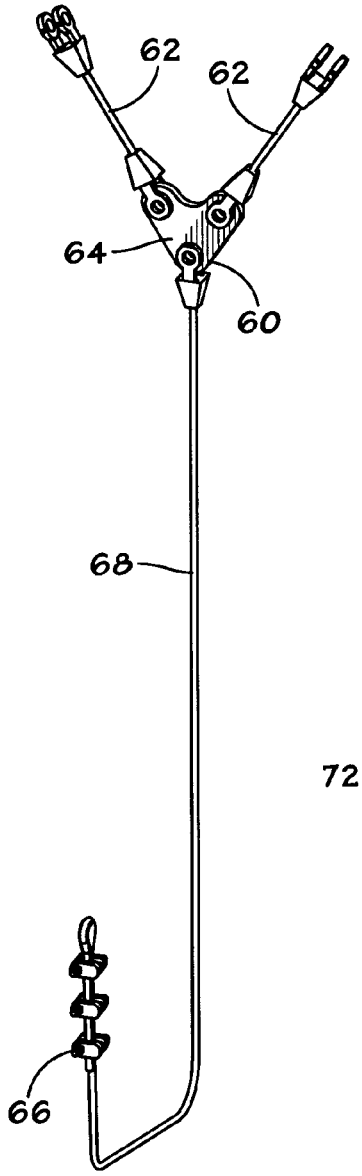
FIG. 5F is a perspective view of a cable assembly of the auger drive unit of FIG. 3A.
Figure 5G:
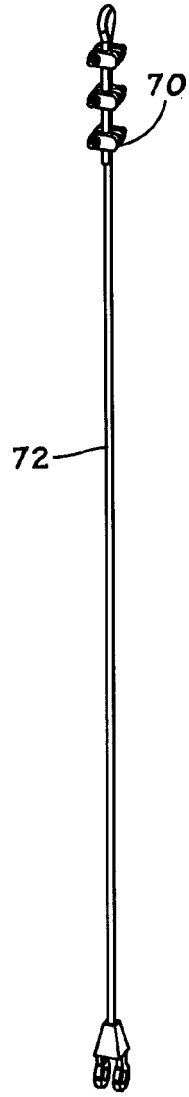
FIG. 5G is a perspective view of a cable assembly of the auger drive unit of FIG. 3A.

FIGS. 2D-2F show one of the guide pivot arms 7*a* in detail. The roller apparatuses 7*b*, 7*d* have two pairs of rollers, a pair of rollers 7*r* and a pair of roller 7*s*, one pair above the other. A chain 7*h* has one end connected to the guide pivot arm 7*a* and the other end connected to the racking board 4.

FIGS. 3A-3D show the auger drive unit 10. A guide rail assembly 30 is secured to a frame 20. Ladders 22 are provided on opposed sides of the frame 20. A base 24 of the frame 20 is connected to and supports frame structural members 25*a*, 25*b*, 25*c* and 25*d*. A housing 40, movable on rails 32 of the guide rail assembly 30, supports a drive 50 which is secured to the housing 40. The drive 50 has a drive shaft 51. Turnbuckles 24*a* (or other suitable connectors releasably secured to lugs 24*b*) are used to secure the frame 24 to the drill floor 8.

The rails 32 are supported by arms 33 of a base 34. Stoppers 33 are used to stop the housing. The base 34 has a cross member 35 with a guide tube 36 through which passes an extension or an auger connected to the drive unit 50. Pins 29 selectively pin the base 34 to base 24 of the frame 20.

A cable assembly 60, connected to the housing 40, has two cable connectors 62 each connected between the housing 40 and a link 64. The cable 11 is connected to a third cable connector 66 which is connected to the link 64. A cable 68 of the connector 66 passes under and around a sheave 25 and through a roller apparatus 26 and is then connected to the cable 11 from the sheave 2*e*. Pulling up on the cable 68 pulls the housing 40 and the drive unit 50 down.

A cable assembly 70 with a cable 72 is connected to the housing 40 and extends up through a roller assembly 80 between the rollers 82. The roller assembly 80 is secured to the guide rail assembly 30. The cable 72 is used to lift drive unit 10 with the drive 50, e.g., to add additional extension member(s).

Each rail 32 has a top member 38 with two plates 38*p* each with a plurality of holes 38*h*. A frame top member 31*l* has cross members 31*a*, 31*b* each with a plurality of holes 31*h* which correspond to and are adjacent holes 38*h* of the top members 38 of the rails 32. Pins 31*p* which extend through a hole 31*h* and a hole 38*h* to secure the guide rail assembly 30 in position so that the auger 16 is at a desired angle for drilling an auxiliary hole at a desired angle.

The housing 40 has two side members 42 through which pass the rails 32 and a top member 44 interconnected between the side member 42. Clamps 46 secured to the side members 42 hold the drive unit 50 in place in the housing 40. Lugs 58 of the drive unit 50 are releasably pinned to lugs 48. The clamps 46 are held in a recess 56 of a housing 59 of the drive unit 50. The cable assembly 70 is connected to a lug 49 of the housing 40. Lugs 201 provide lifting points for the frame 20. The drive 50 is a commercially auger drive unit.

Figure 6A:
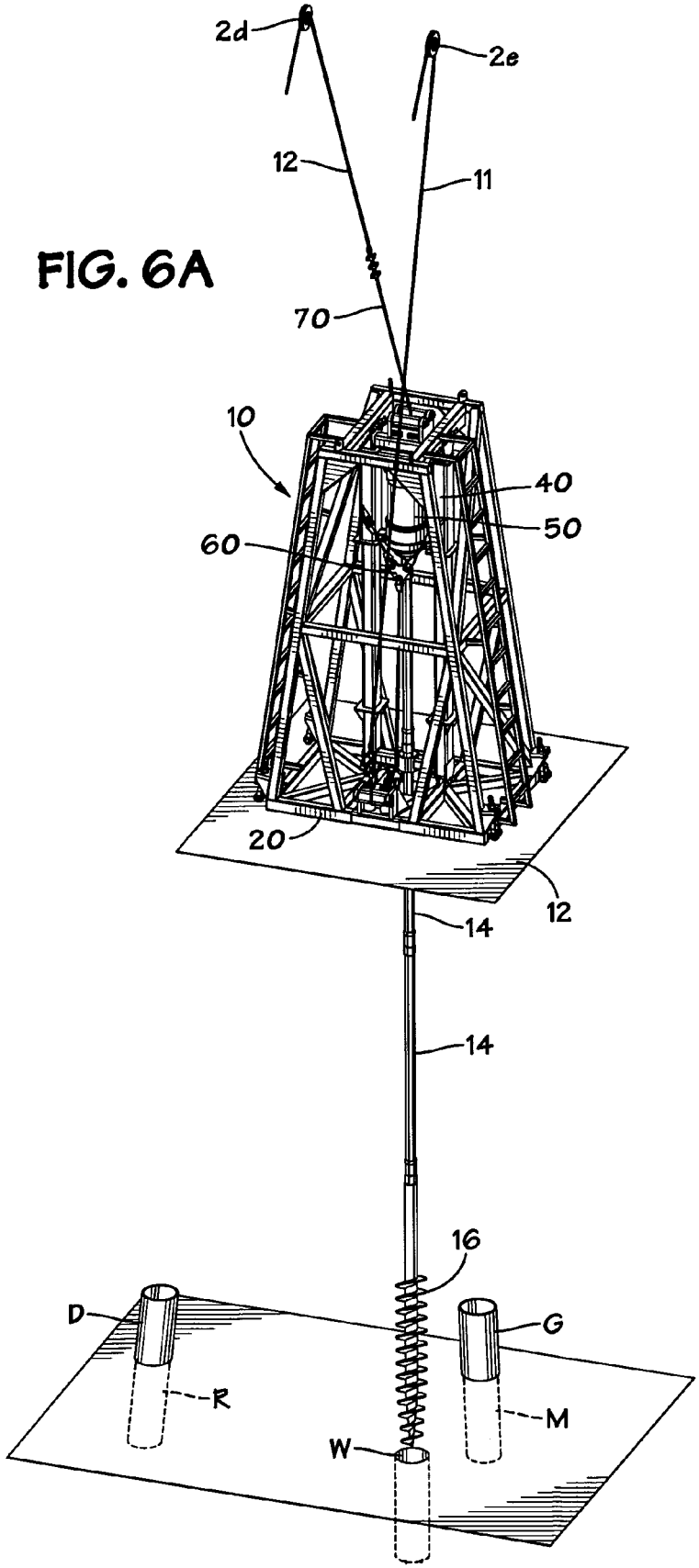
FIG. 6A is a perspective view of an auger drive unit according to the present invention ready to drill a hole.
Figure 6B:
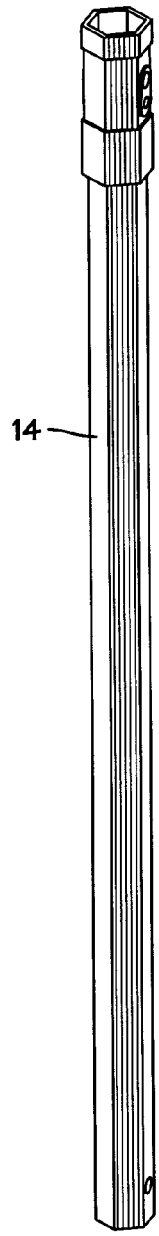
FIG. 6B is a perspective view of an extension used in drilling with the auger drive unit of FIG. 3A.

As shown in FIG. 6A, the auger drive unit 10 is preparing to drill a conductor hole through a well center W. The guide rail assembly 30 can be repositioned for drilling a mousehole M through a guide G or a rathole R through a guide D. The angle of these holes is shown in dotted lines (although the holes themselves are in the earth and not directly adjacent the drill floor).

FIGS. 7A, 8A, and 9A show different positions for the auger drive unit 10 for drilling different auxiliary holes.

Figure 7C:
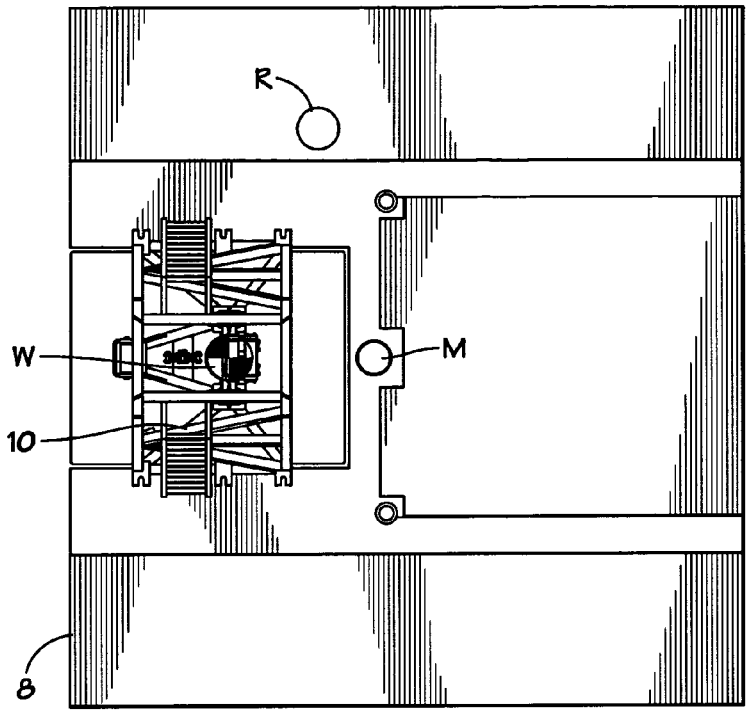
FIG. 7C is a side view of part of the auger drive unit of FIG. 7A.
Figure 7C:
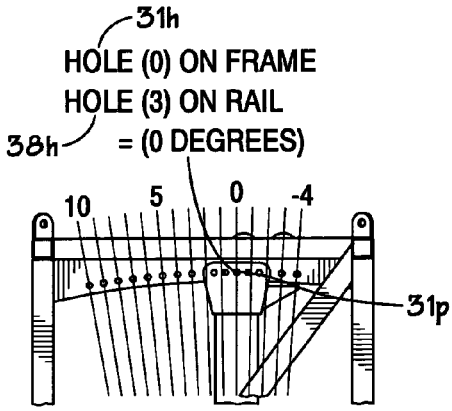
Figure 7B:
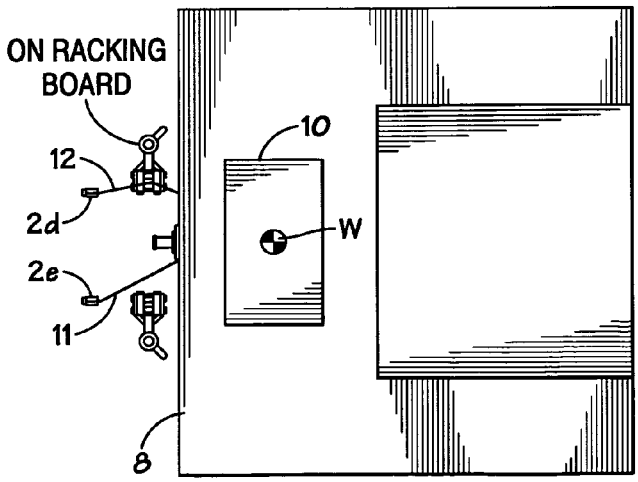
FIG. 7B is a top schematic view of the rig of FIG. 7A.

As shown in FIGS. 7A and 7B, the auger drive unit 10 is positioned for drilling a conductor hole at well center W. As shown in FIG. 7C, so that the auger 16 is substantially aligned vertically above the well center W (angle of 0 degrees), the pins 31*p* are inserted through specific holes 31*h* of the frame and 38*h* of the guide rail assembly to achieve this alignment.

As shown in FIG. 7B, for drilling a conductor hole, the cable 11 goes to the winch 2*b* and the cable 12 goes to the winch 2*a*. The cable going to the winch 2*b* does not go through the guide pivot arm rollers as shown in FIG. 2C. The cable 11—going to the winch 2*b*—does not go through the guide pivot arm rollers on the racking board. The guide pivot arm rollers are used to allow the cables a clear passage around a travelling block or where any other obstructions can interfere with the cables 11 and 12. These rollers are optional.

Figure 8C:
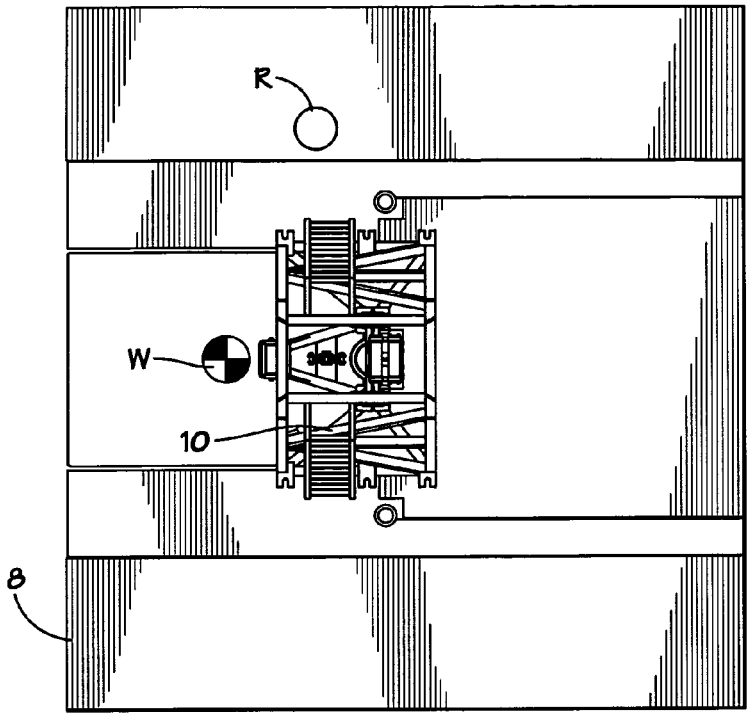
FIG. 8C is a side view of part of the auger drive unit of FIG. 8A.
Figure 8C:
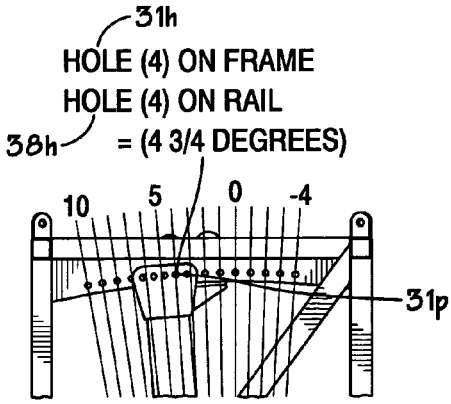
Figure 8B:
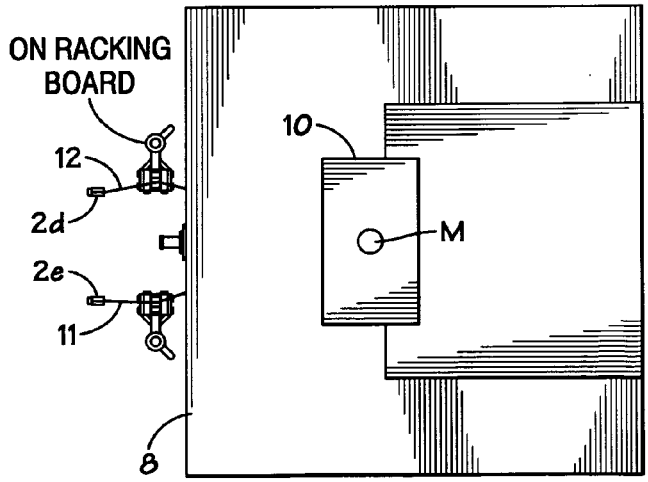
FIG. 8B is a top schematic view of the rig of FIG. 8A.

As shown in FIGS. 8A and 8B, the auger drive unit 10 is positioned for drilling a mousehole M. As shown in FIG. 8C, the pins 31*p* are inserted through specific holes 31*h*, 38*h* so that the auger unit 10 is at the desired angle (e.g. 4.75 degrees) for drilling a mousehole.

As shown in FIG. 8B, for drilling a mousehole, the cable 11 goes to the winch 2*b* and the cable 12 goes to the winch 2*a*. The cables 11, 12 go through guide pivot arm rollers as shown in FIG. 2C.

Figure 9B:
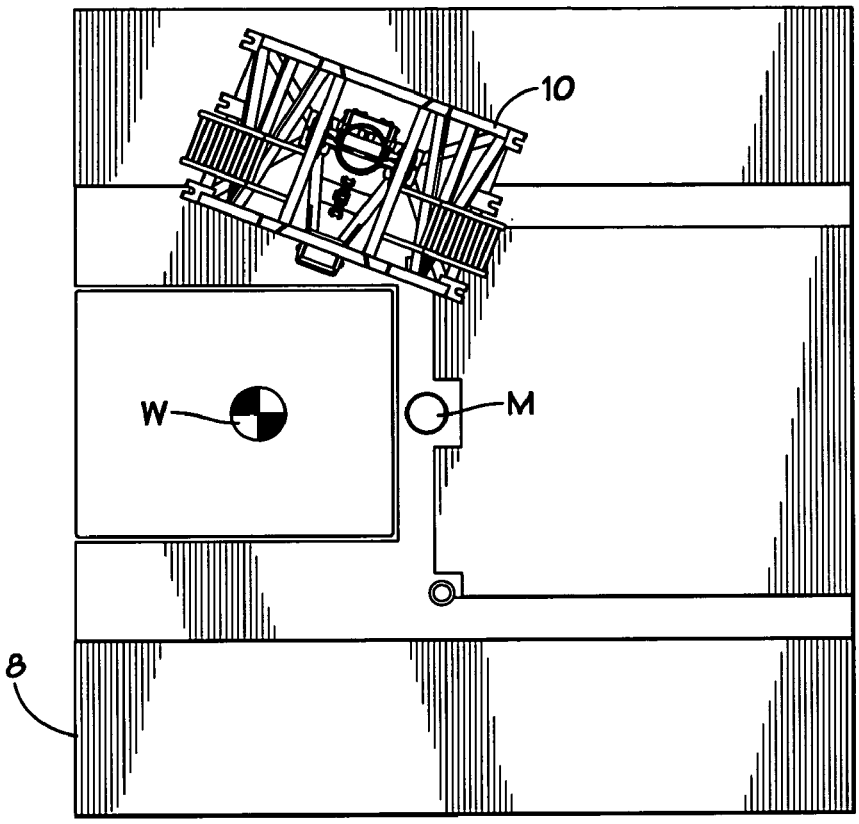
Figure 9B:
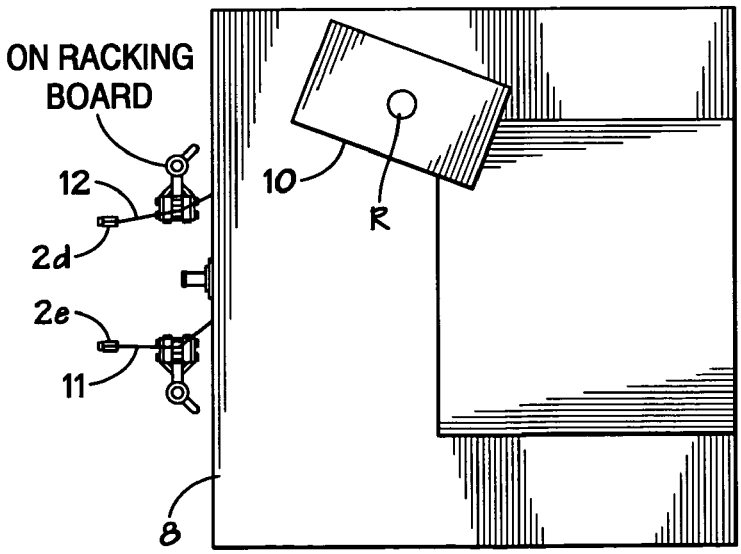
Figure 9C:
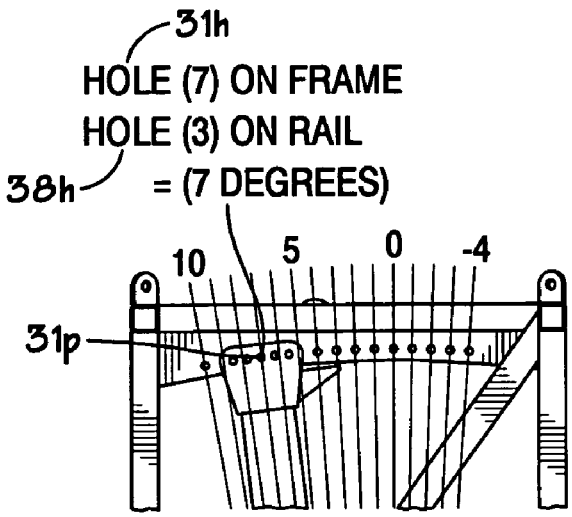
Figure 9D:
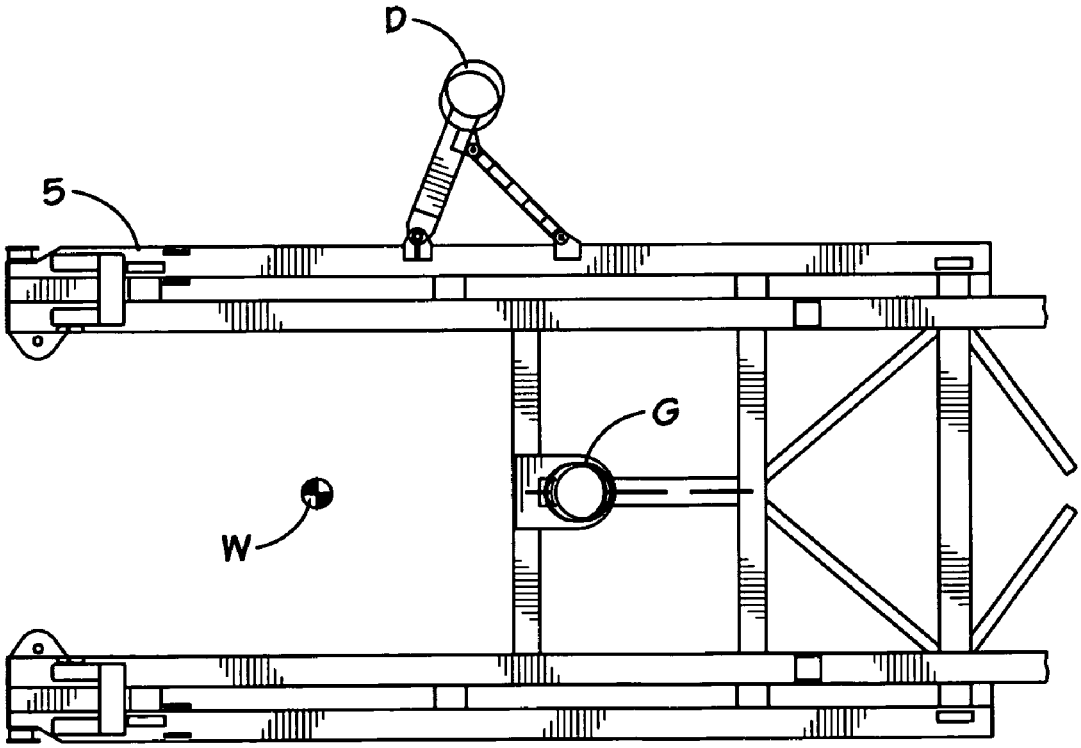
FIG. 9D is a top view of part of the rig of FIG. 9A.

As shown in FIGS. 9A and 9B, the auger drive unit 10 is positioned for drilling a rathole R. As shown in FIG. 9C, the pins 31*p* are inserted through specific holes 31*h*, 38*h* so that the auger unit 10 is at a desired angle (e.g. 7 degrees) for drilling a rathole.

As shown in FIG. 9B, for drilling a rathole, the cable 11 goes to the winch 2*b* and the cable 12 goes to the winch 2*a*. Both cables go through the pivot arm rollers on both sides of the racking board.

FIGS. 10A-10C illustrate steps in methods according to the present invention using a rig according to the present invention and an auger drive unit according to the present invention.

As shown in FIG. 10A, while cable 12 supports the housing 40 and the drive unit 50, pulling up on the cable 11 results in a downward force on the housing 40, drive unit 50 and the auger 16 to drill an auxiliary hole X. Both the weight of the housing 40 and drive unit 50 and the downward force exerted by the cable 11 forces the auger 16 down. It is within the scope of the present invention (as is true of any system and of any method herein according to the present invention) that, as desired, the upward pulling of the cable 11 can be eliminated and the auxiliary hole can be drilled using solely the weight on the auger to provide a downward force (e.g., in loose earth).

As shown in FIG. 10A, the auger drive unit 10 has reached a lower limit of its travel. As shown in FIG. 10B, pulling up on the cable 12 raises the auger drive unit 50 so that another extension 14 can be added above the auger 16 for further downward drilling. The cable 11 has, correspondingly, moved down allowing the auger drive unit 50 to be raised.

As shown in FIG. 10C, an additional extension 14 has been added, connected to the drive shaft 51 of the auger drive unit 10. Upon raising of the drive 50, this additional extension 14 is connected to the uppermost extension 14 above the auger 16 for further downward drilling.

FIGS. 11A and 11B illustrate different ways to secure the frame 20 to the drill floor 8.

As shown in FIG. 11A a turnbuckle device 24*t* (like the turnbuckles 24*a* described above) is connected to a lug 24*b* and is releasably pinned with a pin 95*a* to a lug 12*m*. The lug 12*m* is releasably pinned with a pin 95*b* to a hideaway lug frame 96 which is part of the drill floor 8. A pin 95*c* pins the lug 12*m* in an upright position.

As shown in FIG. 11B, a turnbuckle device 24*s* (like the turnbuckles 24*a* described above) is connected to a lug 24*b* and is releasably pinned with a pin 95*d* to a lug 12*r* of a bolting plate 97 which is bolted to the drill floor 8; e.g. a bolting plate welded to the drill floor that the lug assembly can bolt to and from which it can be removed when not needed.

The present invention, therefore, provides in some, but not in necessarily all, embodiments a method for drilling an auxiliary hole useful in wellbore drilling operations, the method including: connecting a support frame to a rig (at any suitable location or position; e.g., but not limited to, to and above a drill floor of the rig); securing a mount structure to the support frame; connecting a drive apparatus to the mount structure, the drive apparatus including a drive unit movable with respect to the mount structure; connecting an auger apparatus to the drive unit; rotating the auger apparatus with the drive unit to drill an auxiliary hole; and drilling the auxiliary hole with the auger apparatus. Such a method may include, in any possible combination, one or some of the following: connecting a primary cable to the drive unit, and pulling on the primary cable to force the drive unit and auger apparatus downwardly to facilitate drilling of the auxiliary hole; wherein the rig includes a primary winch for pulling the primary cable, the method further including pulling the primary cable with the primary winch; wherein the rig has a mast and cable guide apparatus on the mast, the method including guiding the primary cable with the cable guide apparatus; wherein the cable guide apparatus is movably connected to the mast, the method further including moving the cable guide apparatus and the primary cable with respect to the mast; wherein the drive unit includes a housing and the mount structure has a pair of opposed rails, the housing mounted for movement on the pair of opposed rails, the method further including moving the housing on the pair of opposed rails of the mount structure to move the drive unit and the auger apparatus with respect to the rig; wherein the mount structure includes a plurality of spaced-apart mount structure holes and the drive apparatus includes a plurality of corresponding drive apparatus holes, a pin being insertable through one of the mount structure holes and an adjacent drive apparatus hole to releasably pin the drive apparatus at a desired angle to the mount structure, the method including inserting a pin through a mount structure hole and an adjacent drive apparatus hole to hold the drive apparatus at a desired angle to the mount structure so that the drive apparatus is positioned for drilling the auxiliary hole at a desired angle in the earth; wherein the auxiliary hole is one of a conductor hole, a rathole, and a mousehole; following drilling down into the earth with the auger apparatus, raising the drive apparatus to add a drilling extension between the auger apparatus and the drive apparatus for further drilling into the earth; wherein the rig includes a secondary winch for winching a secondary cable, the secondary cable connected to the drive apparatus, the method further including raising the drive apparatus by winching in the secondary cable with the secondary winch; removing the support frame, mount structure, drive apparatus, and auger apparatus from the rig upon completion of the auxiliary hole; and/or wherein the drive unit is not driven by pumped drilling fluid.

The present invention, therefore, provides in some, but not in necessarily all, embodiments a method for drilling an auxiliary hole useful in wellbore drilling operations, the method including connecting a support frame to and above a drill floor of a rig; securing a mount structure to the support frame; connecting a drive apparatus to the mount structure, the drive apparatus including a drive unit movable with respect to the mount structure; connecting an auger apparatus to the drive unit; wherein the mount structure includes a plurality of spaced-apart mount structure holes and the drive apparatus includes a plurality of corresponding drive apparatus holes, a pin being insertable through one of the mount structure holes and an adjacent drive apparatus hole to releasably pin the drive apparatus at a desired angle to the mount structure, the method including inserting the pin through a mount structure hole and an adjacent drive apparatus hole to hold the drive apparatus at a desired angle to the mount structure so that the drive apparatus is positioned for drilling the auxiliary hole at a desired angle in the earth; rotating the auger apparatus with the drive unit to drill an auxiliary hole; connecting a cable to the drive unit; pulling on the primary cable to force the drive unit and auger apparatus downwardly to facilitate drilling of the auxiliary hole; the rig including a primary winch for pulling the primary cable, the method further including pulling the primary cable with the primary winch; and wherein the auxiliary hole is one of a conductor hole, a rathole, and a mousehole; and drilling the auxiliary hole with the auger apparatus.

The present invention, therefore, provides in some, but not in necessarily all, embodiments a system for drilling an auxiliary hole useful in wellbore drilling operations, the system including: a support frame releasably connectable to and above a drill floor of a rig; a mount structure releasably secured to the support frame; a drive apparatus releasably connected to the mount structure, the drive apparatus including a drive unit movable with respect to the mount structure; an auger apparatus releasably connected to the drive unit; and the auger apparatus rotatable by the drive unit to drill an auxiliary hole. Such a system may include, in any possible combination, one or some of the following: a primary cable connected to the drive unit so that pulling on the primary cable to force the drive unit and auger apparatus downwardly to facilitate drilling of the auxiliary hole; a primary winch on the rig for pulling the primary cable; the drive unit including a housing; the mount structure having a pair of opposed rails; the housing mounted for movement on the pair of opposed rails so that moving the housing on the pair of opposed rails of the mount structure moves the drive unit and the auger with respect to the rig; the mount structure including a plurality of spaced-apart mount structure holes and the drive apparatus including a plurality of corresponding drive apparatus holes, a pin inserted through one of the mount structure holes and an adjacent drive apparatus hole releasably pinning the drive apparatus at a desired angle to the mount structure to hold the drive apparatus at a desired angle to the mount structure so that the drive apparatus is positioned for drilling the auxiliary hole at a desired angle in the earth; and/or raising apparatus connected to the rig for raising the drive apparatus to add a drilling extension between the auger apparatus and the drive apparatus for further drilling into the earth.

The present invention, therefore, provides in some, but not in necessarily all, embodiments an auxiliary hole drilled in the earth by any method according to the present invention for drilling an auxiliary hole useful in wellbore drilling operations, the method, in one aspect, including: connecting a support frame to a rig; securing a mount structure to the support frame; connecting a drive apparatus to the mount structure, the drive apparatus including a drive unit movable with respect to the mount structure; connecting an auger apparatus to the drive unit; and rotating the auger apparatus with the drive unit to drill the auxiliary hole.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for drilling an auxiliary hole useful in wellbore drilling operations, the method comprising connecting a support frame to and above a drill floor of a rig, securing a mount structure to the support frame, connecting a drive apparatus to the mount structure, the drive apparatus including a drive unit movable with respect to the mount structure, connecting an auger apparatus to the drive unit, rotating the auger apparatus with the drive unit to drill an auxiliary hole, drilling the auxiliary hole with the auger apparatus, the auxiliary hole spaced-apart from a location of a main wellbore, removing the support frame, mount structure, drive apparatus, and auger apparatus from the rig upon completion of the auxiliary hole before drilling the main wellbore, and installing main drilling equipment on the rig for drilling the main wellbore wherein the mount structure includes a plurality of spaced-apart mount structure holes and the drive apparatus includes a plurality of corresponding drive apparatus holes, and a pin being insertable through one of the mount structure holes and an adjacent drive apparatus hole to releasably pin the drive apparatus at a desired angle to the mount structure, the method further comprising inserting the pin through a mount structure hole and an adjacent drive apparatus hole to hold the drive apparatus at a desired angle to the mount structure so that the drive apparatus is positioned for drilling the auxiliary hole at a desired angle in the earth.

2. The method of claim 1 further comprising connecting a primary cable to the drive unit, and pulling on the primary cable to force the drive unit and auger apparatus downwardly to facilitate drilling of the auxiliary hole.

3. The method of claim 2 wherein the rig includes a primary winch for pulling the primary cable, the method further comprising pulling the primary cable with the primary winch.

4. The method of claim 3 wherein the rig has a mast and cable guide apparatus on the mast, the method further comprising guiding the primary cable with the cable guide apparatus.

5. The method of claim 4 wherein the cable guide apparatus is movably connected to the mast, the method further comprising moving the cable guide apparatus and the primary cable with respect to the mast.

6. The method of claim 1 wherein the drive unit includes a housing and the mount structure has a pair of opposed rails, the housing mounted for movement on the pair of opposed rails, the method further comprising moving the housing on the pair of opposed rails of the mount structure to move the drive unit and the auger apparatus with respect to the rig.

7. The method of claim 1 wherein the auxiliary hole is one of a conductor hole, a rathole, and a mousehole.

8. The method of claim 1 further comprising following drilling down into the earth with the auger apparatus, raising the drive apparatus to add a drilling extension between the auger apparatus and the drive apparatus for further drilling into the earth.

9. The method of claim 8 wherein the rig includes a secondary winch for winching a secondary cable, the secondary cable connected to the drive apparatus, the method further comprising raising the drive apparatus by winching in the secondary cable with the secondary winch.

10. The method of claim 1 further comprising drilling the main wellbore.

11. The method of claim 1 wherein the drive unit is not driven by pumped drilling fluid.

12. A method for drilling an auxiliary hole useful in wellbore drilling operations, the method comprising connecting a support frame to and above a drill floor of a rig, securing a mount structure to the support frame, connecting a drive apparatus to the mount structure, the drive apparatus including a drive unit movable with respect to the mount structure, connecting an auger apparatus to the drive unit, wherein the mount structure includes a plurality of spaced-apart mount structure holes and the drive apparatus includes a plurality of corresponding drive apparatus holes, a pin being insertable through one of the mount structure holes and an adjacent drive apparatus hole to releasably pin the drive apparatus at a desired angle to the mount structure, the method comprising inserting the pin through a mount structure hole and an adjacent drive apparatus hole to hold the drive apparatus at a desired angle to the mount structure so that the drive apparatus is positioned for drilling the auxiliary hole at a desired angle in the earth, rotating the auger apparatus with the drive unit to drill an auxiliary hole, connecting a cable to the drive unit, pulling on the primary cable to force the drive unit and auger apparatus downwardly to facilitate drilling of the auxiliary hole, wherein the rig includes a primary winch for pulling the primary cable, the method further comprising pulling the primary cable with the primary winch, wherein the auxiliary hole is one of a conductor hole, a rathole, and a mousehole, and, drilling the auxiliary hole with the auger apparatus, the auxiliary hole spaced-apart from a location of a main wellbore, and removing the support frame, mount structure, drive apparatus, and auger apparatus from the rig upon completion of the auxiliary hole before drilling the main wellbore.

13. A system for drilling an auxiliary hole useful in wellbore drilling operations, the system comprising a support frame releasably connectable to and above a drill floor of a rig, a mount structure releasably secured to the support frame, a drive apparatus releasably connected to the mount structure, the drive apparatus including a drive unit movable with respect to the mount structure, an auger apparatus releasably connected to the drive unit, the auger apparatus rotatable by the drive unit to drill an auxiliary hole spaced-apart from a location of a main wellbore, and a primary cable connected to the drive unit so that pulling on the primary cable forces the drive unit and auger apparatus downwardly to facilitate drilling of the auxiliary hole, the mount structure including a plurality of spaced-apart mount structure holes and the drive apparatus including a plurality of corresponding drive apparatus holes, and a pin inserted through one of the mount structure holes, and an adjacent drive apparatus hole releasably pinning the drive apparatus at a desired angle to the mount structure to hold the drive apparatus at a desired angle to the mount structure so that the drive apparatus is positioned for drilling the auxiliary hole at a desired angle in the earth.

14. The system of claim 13 further comprising a primary winch on the rig for pulling the primary cable.

15. The system of claim 13 further comprising the drive unit including a housing, the mount structure having a pair of opposed rails, the housing mounted for movement on the pair of opposed rails so that moving the housing on the pair of opposed rails of the mount structure moves the drive unit and the auger with respect to the rig.

16. The system of claim 13 further comprising raising apparatus connected to the rig for raising the drive apparatus to add a drilling extension between the auger apparatus and the drive apparatus for further drilling into the earth.

* * * * *